US006608291B1

(12) United States Patent
Collins et al.

(10) Patent No.: US 6,608,291 B1
(45) Date of Patent: Aug. 19, 2003

(54) INDUCTION HEATING APPARATUS

(76) Inventors: Roberto A. Collins, 905 Foothill Dr., San Jose, CA (US) 95123; James B. Colvin, 36217 Worthing Dr., Newark, CA (US) 94560

( * ) Notice: Subject to any disclaimer, the term of this patent is extended or adjusted under 35 U.S.C. 154(b) by 0 days.

(21) Appl. No.: 09/811,857

(22) Filed: Mar. 19, 2001

Related U.S. Application Data

(60) Provisional application No. 60/190,562, filed on Mar. 20, 2000.

(51) Int. Cl.[7] ..... H05B 6/08
(52) U.S. Cl. ..... 219/662; 219/663
(58) Field of Search ..... 219/662, 663, 219/660, 661, 626, 665, 666, 627, 629, 552, 603; 330/264; 99/422

(56) References Cited

U.S. PATENT DOCUMENTS 3,742,174 A * 6/1973 Harnden, Jr. ..... 219/627
3,820,005 A * 6/1974 Steigerwald ..... 363/96
4,013,859 A * 3/1977 Peters, Jr. ..... 216/626
4,308,448 A * 12/1981 Beck et al. ..... 219/552
4,757,176 A * 7/1988 Suzuki et al. ..... 219/627
4,760,349 A * 7/1988 Park et al. ..... 330/264
5,239,916 A * 8/1993 Hu ..... 99/442
5,504,309 A * 4/1996 Geissler ..... 219/663
5,968,398 A * 10/1999 Schmitt et al. ..... 219/626
6,188,052 B1 * 2/2001 Trucco ..... 219/603
6,211,498 B1 * 4/2001 Patridge et al. ..... 219/660
6,320,169 B1 * 11/2001 Clothier ..... 219/626

* cited by examiner

*Primary Examiner*—Teresa Walberg
*Assistant Examiner*—Quang T Van
(74) *Attorney, Agent, or Firm*—Danamraj & Youst, P.C.

(57) ABSTRACT

A portable induction heating system which utilizes a broadband high frequency high-power, low output impedance power generator formed from switching MOSFET devices. A voltage-controlled oscillator (VCO) or microprocessor-controlled signal generator drives a power output stage under feedback control so as to effectuate resonance at a high frequency in an induction coil assembly connected to the power generator. The power generator is operable with a switching regulator that can supply a fixed DC voltage, e.g., 12 to 48 V or a variable setpoint. The induction coil assembly includes a capacitive circuit portion connected to a conductive coil that can couple magnetic field to a susceptor. A microcontroller is provided for inputting operating parameters such as power, frequency, duty cycle and duration, and is operable to auto-tune the VCO output under feedback control by sweeping frequency at startup as well as by controlling drift during operation under a changing load.

28 Claims, 9 Drawing Sheets

INDUCTION HEATING APPARATUS

PRIORITY UNDER 35 U.S.C. §119(e) & 37 C.F.R. §1.78

This nonprovisional application claims priority based upon the following prior United States provisional patent application entitled: Broadband High Frequency High Power Low Output Impedance Power Supply Using Switching MOSFETS, Ser. No.: 60/190,562, filed Mar. 20, 2000, in the names of Roberto A. Collins and James B. Colvin, which is hereby incorporated by reference for all purposes.

BACKGROUND OF THE INVENTION

1. Technical Field of the Invention

The present invention generally relates to induction heating equipment. More particularly, and not by way of any limitation, the present invention is directed to a portable induction heating system utilizing a power generator that is capable of outputting high frequency signals at low impedances.

2. Description of Related Art

The principles underlying the phenomenon of induction heating, i.e., the process of increasing temperature in a conductive component (referred to as a susceptor) by coupling to a magnetic flux generated from an inductive coil, are well known. It is also well known that equipment based on the principles of induction heating is deployed in various fields.

Several deficiencies and drawbacks are extant in the current inductive heating solutions, however. Traditional switching power supply (SPS) systems used for sourcing power in conventional inductive heating equipment are bulky because of the size of the various components employed therein. Also, such SPS systems are typically provided to be operable to drive a relatively higher ohmic resistance, e.g., 50 Ω or so. Accordingly, large step-down transformers are used for matching output to lower impedance loads in order to generate the high current, high frequency signals needed for creating appropriate levels of magnetic coupling. Consequently, the existing induction heating systems are generally not readily amenable to portability.

Further, the operating frequency ranges of today's induction heating systems are not effective in certain important applications. For example, whereas frequency ranges of around 100 KHz generated by the current equipment are suitable for applications such as automotive industry (e.g., selective or localized hardening of crank shafts by rapid annealing and quenching), such frequencies are not useful for coupling to small conductive elements such as, e.g., metallic interconnects in integrated circuits, bonding pads, solder joints, bumps or balls used for attaching multiple semiconductor die together or to various other substrates, or other components having portions with limited effective surface areas that require rapid heat treatment. It is known, however, that substantially higher frequency ranges (in the MHz range) are needed to couple to such tiny susceptors effectively.

In addition, where sufficiently high frequencies are generated, power supplies of such induction systems are typically tuned to and fixed at a particular frequency for achieving resonance. As a consequence, these induction heating systems are not suitable for susceptors of different sizes and shapes because of the resultant changes in resonance frequency which drastically reduce the AC current delivered to the induction coil and create undesirable feedback to the power supply.

SUMMARY OF THE INVENTION

Accordingly, the present invention provides a portable induction heating system which utilizes a broadband high frequency high-power, low output impedance power generator formed from switching MOSFET devices for directly coupling to low impedance inductive coil loads. In the presently preferred exemplary embodiment, the power generator circuit is designed to drive extremely low impedance loads on the order of a fraction of an ohm, thereby advantageously avoiding the need to match the power output of a conventional switching power supply by incorporating bulk step-down transformer systems. Accordingly, the power generator is highly compact and portable, weighing in under 10 pounds, and yet capable of generating high power signals from 0.5 MHz to 20 MHz or greater.

A voltage-controlled oscillator (VCO) or any microprocessor-controlled signal generator drives a power output stage under feedback control so as to effectuate resonance at a high frequency in an induction coil assembly (i.e., load) connected to the power generator. The power generator is operable with a switching regulator that can supply a fixed DC voltage, e.g., from around 10 V to about 50 V. The induction coil assembly (which includes a capacitive circuit portion connected to a conductive coil) couples a magnetic field to a susceptor component for inductively heating it.

A microcontroller is provided for inputting operating parameters such as power, frequency, duty cycle and duration, and is operable to auto-tune the VCO output by sweeping frequency at startup as well as by controlling drift during operation under a changing load. Sensors such as, e.g., temperature, current, phase, and voltage sensors are used to provide feedback to the microcontroller. Preferably, the sensor feedback is used to control power delivered to the load as a function of changing load impedance via changes in frequency, signal duration, and DC voltage.

In one exemplary embodiment of the present invention, the power output stage is comprised of a plurality of buffer pre-driver circuit portions. Each pre-driver portion is capacitively coupled to a driver circuit portion comprising at least one transformer whose secondary coil is operable to drive the gate of an NMOS device. The output of the driver circuit portion is staged through a plurality of NMOS devices organized into two banks for alternately switching output power to the load via a connector.

In another exemplary embodiment, the power output stage includes a pure MOSFET design, wherein the use of transformers in the pre-driver circuitry is eliminated. The driver circuitry in this embodiment is preferably comprised of NMOS and PMOS devices in a CMOS circuit arrangement with appropriate DC offsets provided for the gates. The output of the driver circuitry is staged through a bank of NMOS devices and a bank of PMOS devices for driving the low impedance coil assembly load.

A variety of coil configurations can be provided for use with the induction heating system provided in accordance with the teachings of the present invention. Because the series resonant coil and the capacitive circuit portion coupled thereto are preferably provided as a module external to the power generator, appropriate capacitor/coil combinations may be had for target-specific applications.

BRIEF DESCRIPTION,OF THE DRAWINGS

A more complete understanding of the present invention may be had by reference to the following Detailed Description when taken in conjunction with the accompanying drawings wherein.

DETAILED DESCRIPTION OF THE DRAWINGS

Figure 1:
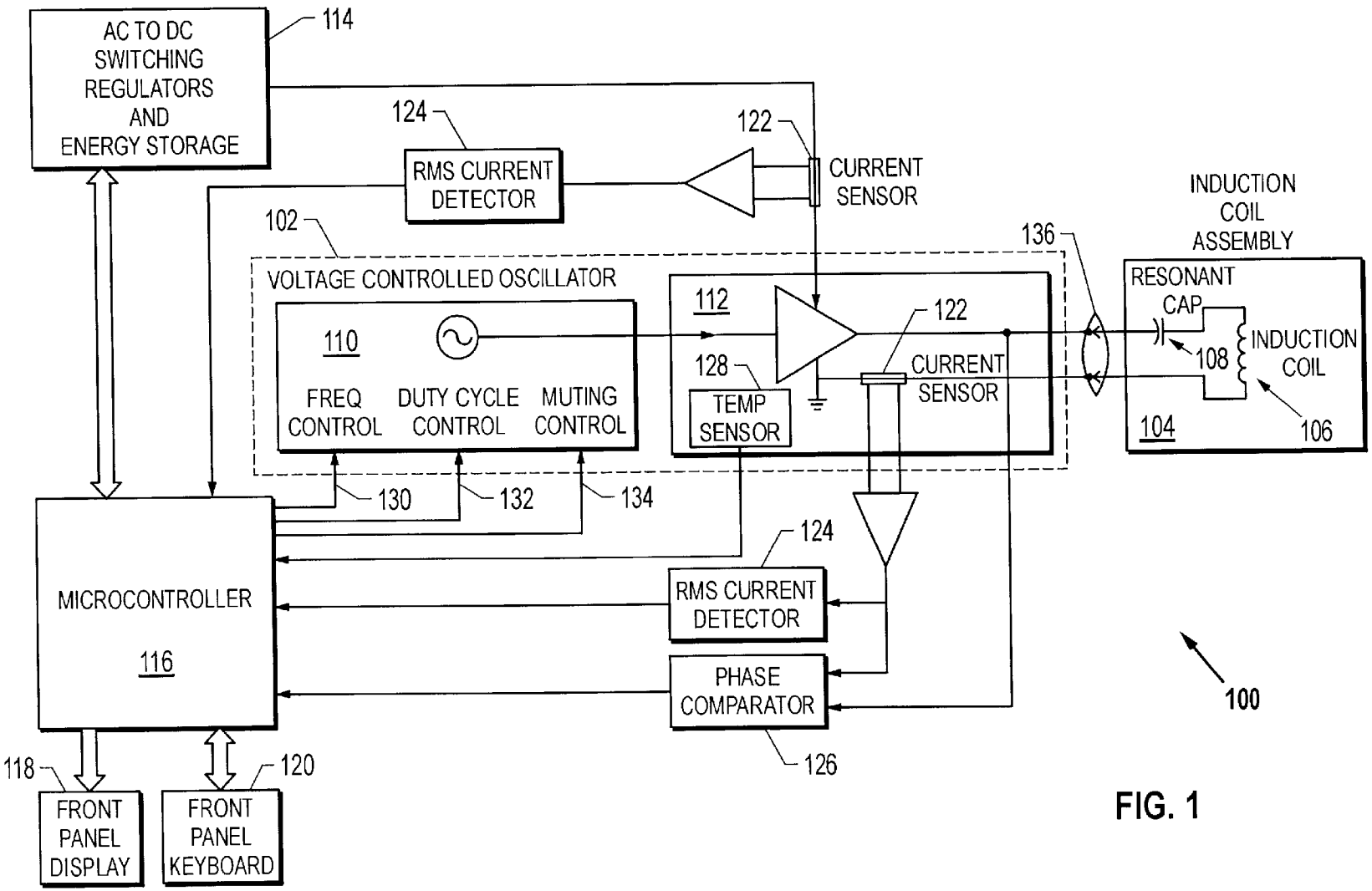
FIG. 1 depicts a functional block diagram of a presently preferred exemplary embodiment of an induction heating system or apparatus provided in accordance with the teachings of the present invention.

In the drawings, like or similar elements are designated with identical reference numerals throughout the several views thereof, and the various elements depicted are not necessarily drawn to scale. Referring now to FIG. 1, depicted therein is a functional block diagram of a presently preferred exemplary embodiment of an induction heating system or apparatus 100 provided in accordance with the teachings of the present invention. A power generator block 102 comprising a voltage-controlled oscillator (VCO) 110 and a power output stage 112 is provided as a broadband high frequency, low output impedance power supply that is operable with a switching regulator 114 for providing current in the frequency range varying from about 0.5 MHz or greater to an induction coil assembly load 104. A connector 136 operable to carry power and ground signals is provided to couple the induction coil assembly 104 to the power output stage 112 of the power generator 102.

The induction coil assembly 104 is preferably comprised of a capacitive circuit portion 108 that is coupled to a conductive coil 106, giving rise to an R-L-C series circuit arrangement wherein the resistive "R" component models the "parasitic" resistance of the connector 136 and other components of the signal path that exhibit resistive losses. As is well known, a low impedance state is achieved when the R-L-C model circuit operates at what is termed the series resonant frequency of the circuit.

The VCO block 110 is operable to provide a predetermined waveform (e.g., square, triangular, etc.) whose frequency can be varied by a DC voltage, and drives the output stage 112 (described in greater detail hereinbelow) of the power generator 102. Also, it should be recognized by those skilled in the art that any microprocessor-controlled signal generator may also be utilized for providing appropriate signal waveforms. As alluded to in the foregoing, reference numeral 114 in the functional block diagram depicted in FIG. 1 refers to a consolidated block of one or more AC-to-DC switching regulators and associated energy storage equipment. Preferably, VCO 110 has a linear voltage-to-frequency conversion, good frequency stability, and ease of tuning control. A plurality of sensors and detectors, e.g., temperature sensors 128, current sensors 122, voltage sensors (not explicitly shown in FIG. 1), Root-Mean-Square (RMS) current detectors 124, and phase comparators 126, et cetera, are provided for effectuating appropriate feedback to a microcontroller 116 in order to implement computer-based feedback control. The sensor feedback is used in the presently preferred exemplary embodiment of the present invention to control power delivered to the load as a function of the changing load impedance via changes in frequency and signal duration. Suitable man-machine interfaces such as a front panel display 118, keyboard 120, pointing devices (not shown) , etc. are accordingly provided in conjunction with the microcontroller 116.

A plurality of input control signals, e.g., frequency control 130, duty cycle control 132, muting control 134, operating power and the like are provided to VCO 110 via the microcontroller 116 for controlling the operation of the induction heating system 100. Magnetic field generated in response to the high frequency current in the induction coil assembly 104 is operable to be coupled to any conductive work piece (i.e., susceptor) that is presented for heating. As is well known in the induction art, applied magnetic flux ($\Phi$) is dependent on the effective surface area coupled and produces what are known as "eddy currents" in the susceptor material that give rise to the heating thereof.

Continuing to refer to FIG. 1, the DC supply 114 may preferably be comprised of a fixed voltage at 12, 24, or up to 48 V, or at any variable setpoint that is appropriate. As alluded to hereinabove, the output generated by the power generator 102 is coupled to the induction coil assembly load 104 that can be placed in resonance in order to achieve a broad range of impedances, from very low impedances on the order of a fraction of an ohm (e.g., about 0.1$\Omega$) to a theoretical infinite impedance value. The microcontroller arrangement 116 is operable to auto-tune the frequency output by sweeping frequency at startup as well as by controlling drift during operation under a changing load that can be caused by the proximate susceptor. Those skilled in the art should appreciate that feedback produced due to out-of-matching loads in the conventional induction heating solutions, which can be dangerous if uncontrolled, is advantageously reduced accordingly in the practice of the present invention.

The connector arrangement 136 coupling the induction coil assembly load 104 to the output stage 112 of the power generator 102 may be implemented by using a variety of mechanisms such as, e.g., shielded or unshielded coaxial cables, twisted pair conductors organized into ribbon cables with variable pin counts, etc. Favorable results have been obtained by using the twisted pair ribbon connectors with a relatively large pin count (e.g., about 72 pins or so) where every other pin is grounded (thereby effectuating what is known as cancellation coupling). On the other hand, coaxial cabling has been observed to waste energy and require further impedance matching.

Because the connector arrangement 136 may preferably be implemented as a flexible ribbon cable, the positioning of the induction coil assembly 104 can be highly variable, which can give rise to numerous advantageous applications where induction heating is desired in remotely located or hard to reach susceptors. Further, by coupling a robotic arm having multiple degrees of freedom with the connector cable 136, the present induction heating system 100 may be provisioned as in-line equipment in a manufacturing line such as, e.g., a front-end or back-end semiconductor fabrication facility.

Figure 2:
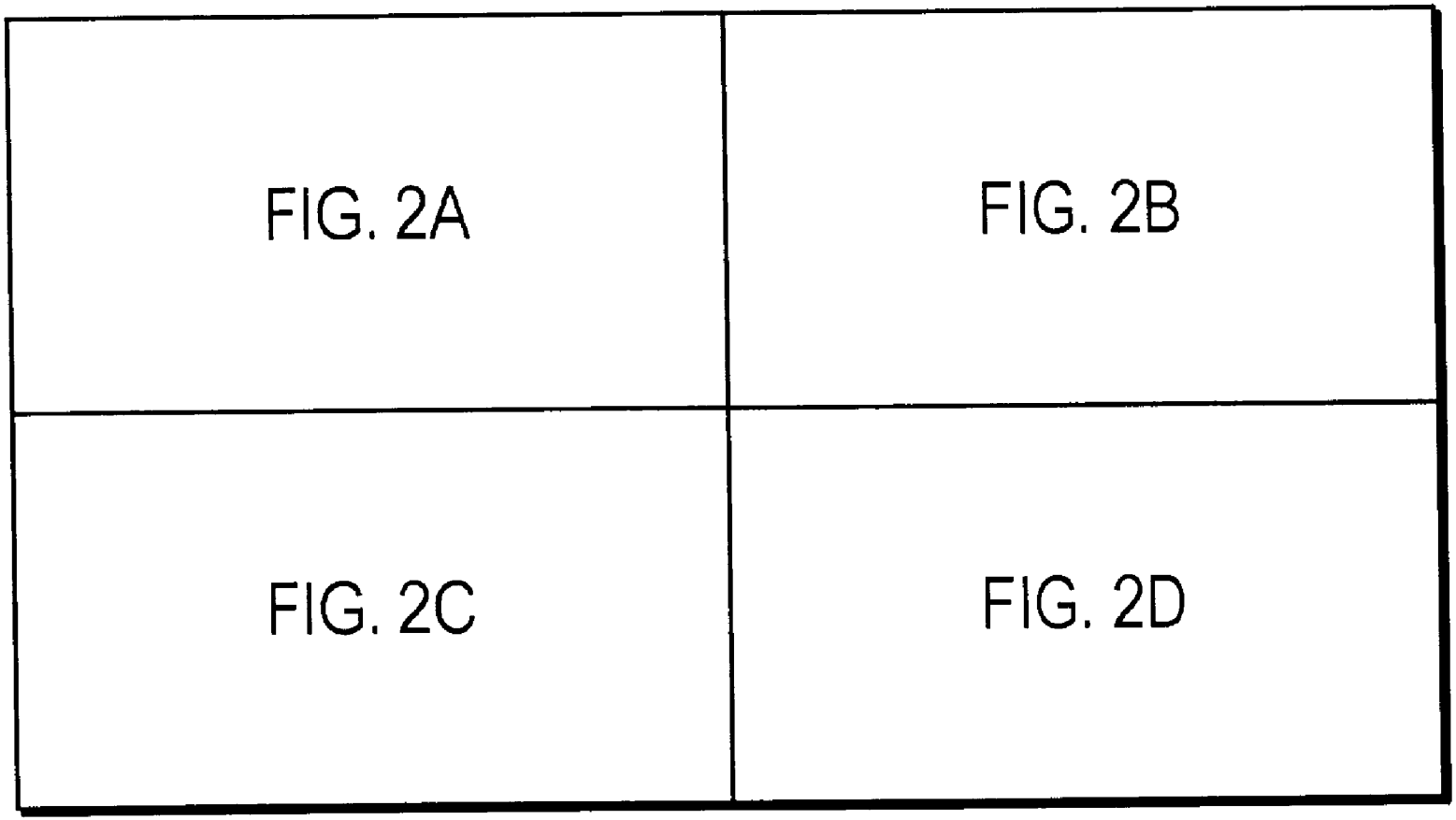
FIG. 2 depicts a circuit diagram of a first exemplary embodiment of a power output stage for use in the induction heating system of the present invention.
Figure 2A:
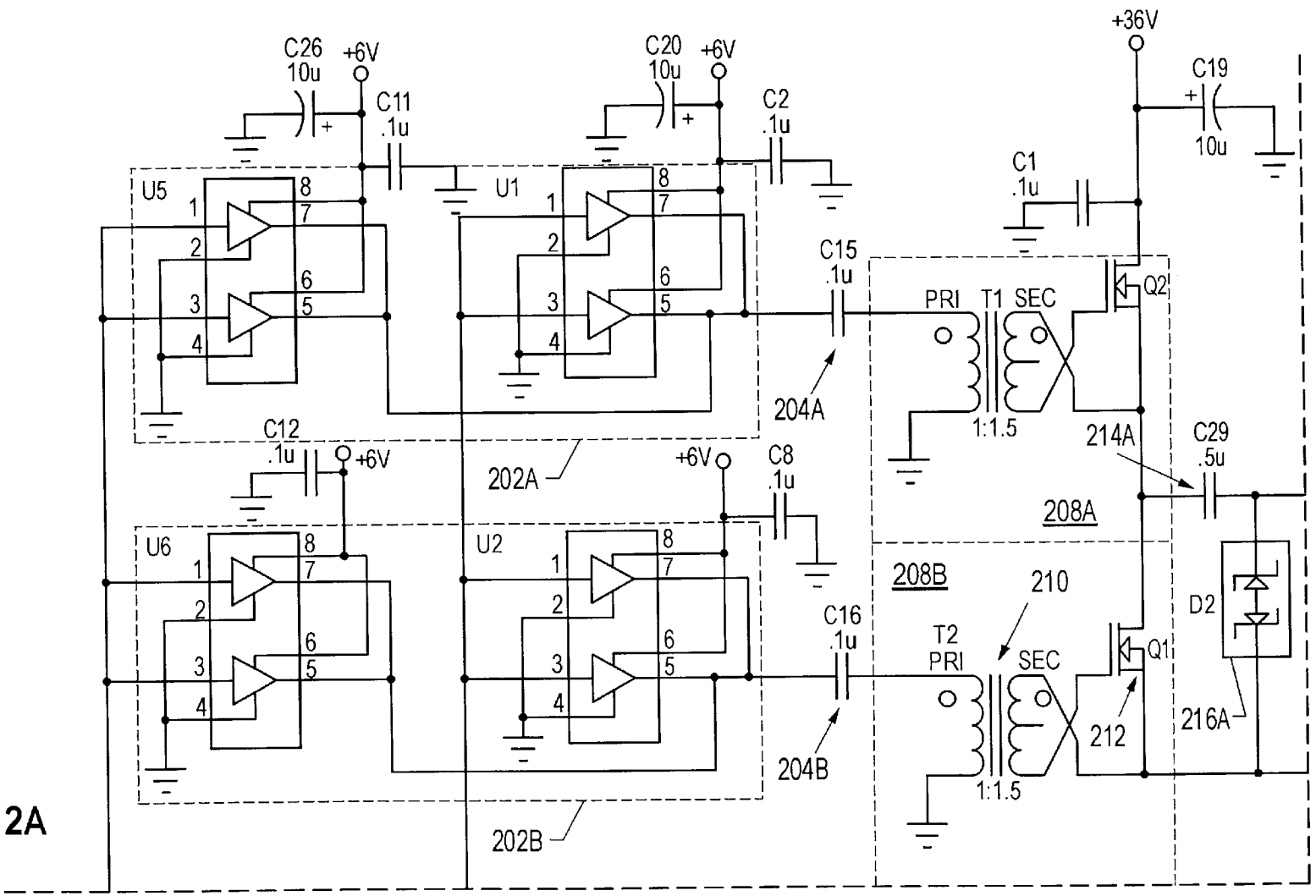
Figure 2B:
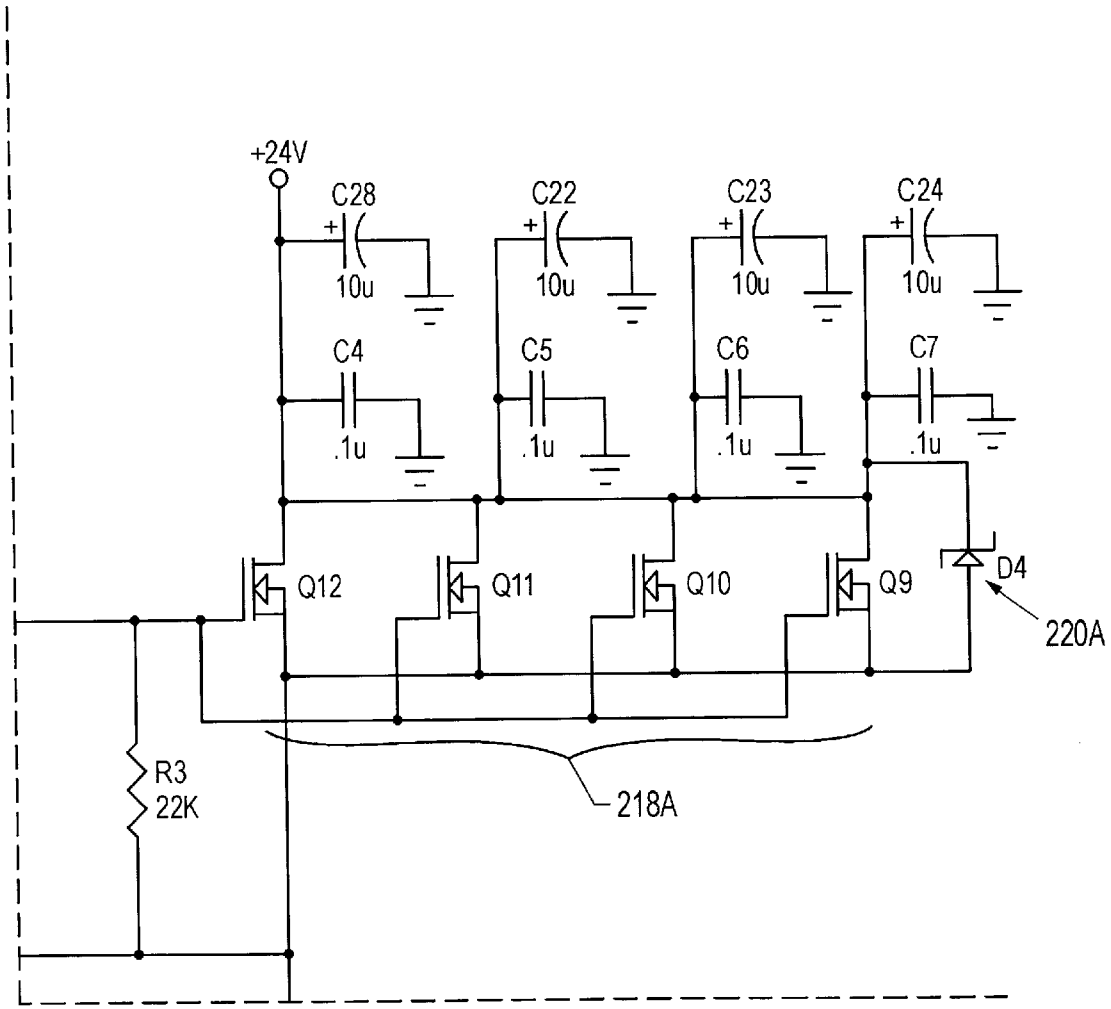
Figure 2C:
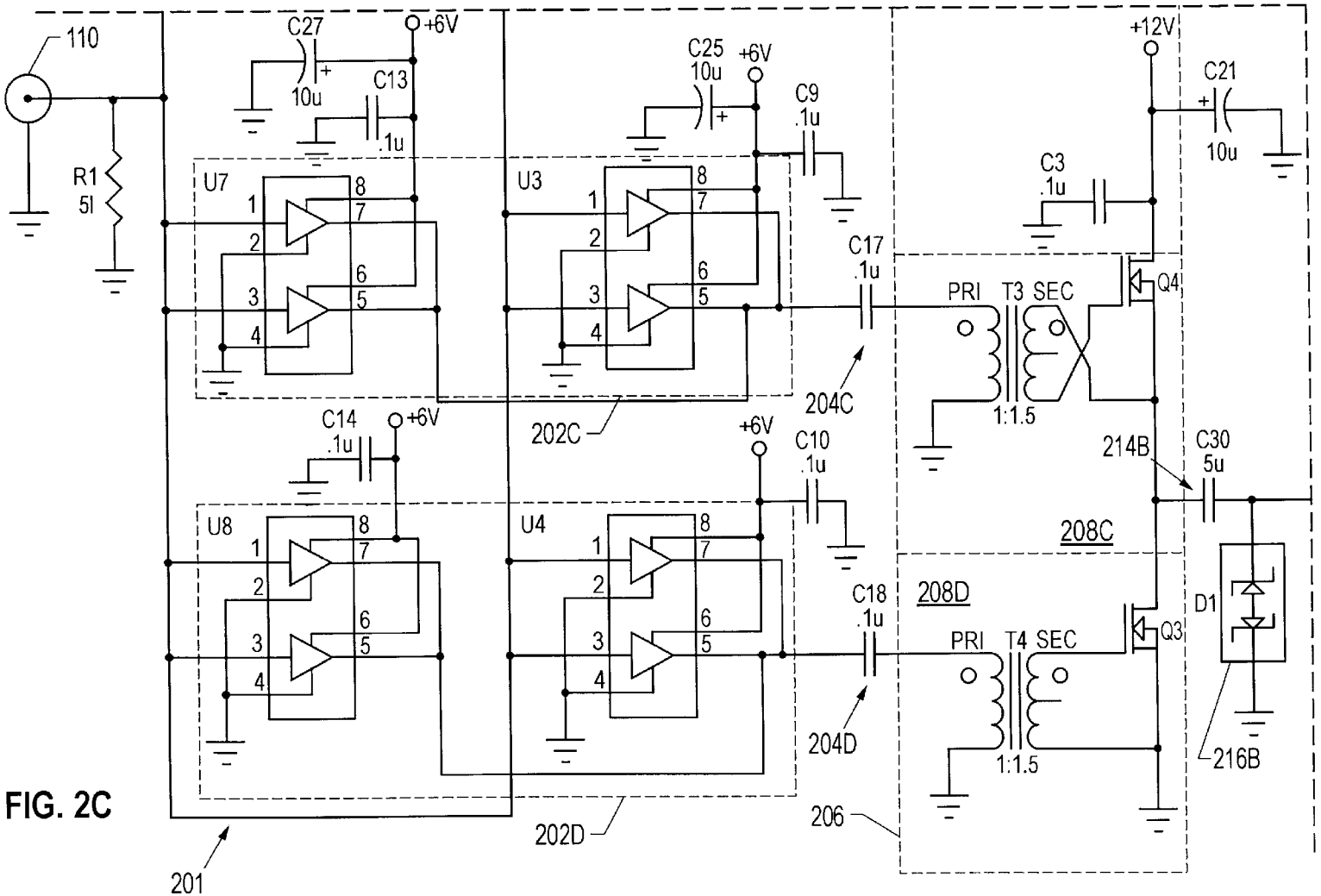
Figure 2D:
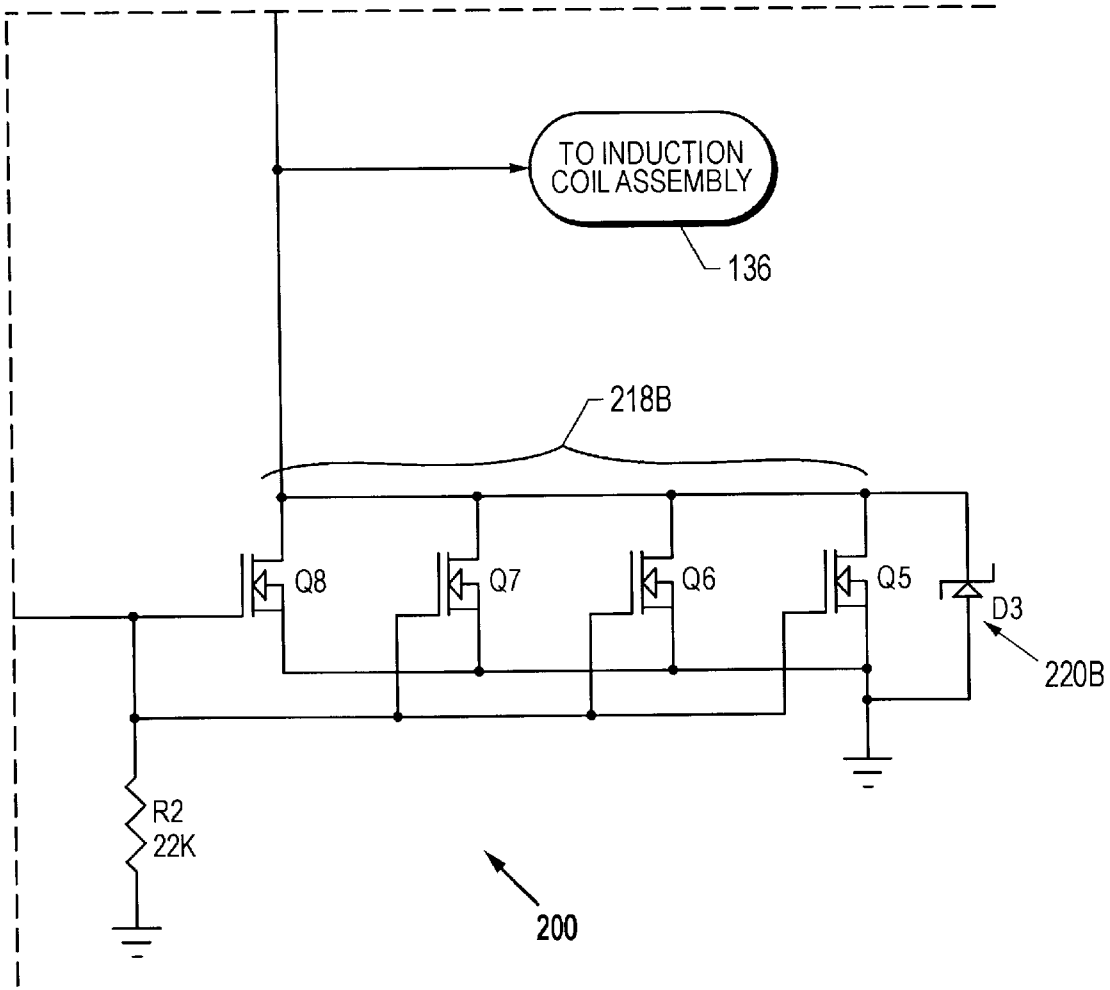

Referring now to FIG. 2, which incorporates sub-figures 2A, 2B, 2C, and 2D, depicted therein is a circuit diagram of a first exemplary embodiment of a power output stage 200 for use in the induction heating apparatus of the present invention. The VCO output 110 is provided to a pre-driver circuit portion 201 comprised of a plurality of buffer circuits, e.g., buffer pre-drivers 202A through 202D. The pre-driver buffer circuitry is operable with a suitable power supply (e.g., +6 VDC) and is provided with appropriate decoupling capacitors, e.g., C20 and C25 for pre-driver buffer 202A.

The pre-driver buffer circuit portion 201 is capacitively coupled to a driver circuit portion 206 comprising a plurality of driver blocks, e.g., driver blocks 208A–208D. Each driver block includes a transformer (T1 through T4) operable to allow AC coupling to the gates of a driver transistor (Q1 through Q4). In the exemplary embodiment depicted in FIG. 2, the pre-driver buffer circuits are disposed in parallel to achieve the low on-resistance necessary to drive the transformers T1 through T4. Accordingly, four isolation capacitances 204A through 204D are exemplified in the coupling paths between the pre-driver buffer circuits and the corresponding driver blocks of the driver circuitry.

Continuing to refer to FIG. 2, reference numeral 210 refers to transformer T2 coupled to the driver transistor 212 used in the driver block 208B. Transformer 210, preferably provided as a 1:1.5 step-up transformer wherein the secondary side is coupled to the gate of transistor 212, is operable to permit polarity control of the transistor's gate for proper switching. Preferably, the drive transistors in this exemplary embodiment are comprised of n-channel Metal-Oxide Semiconductor field effect transistor (NMOS) devices due to their superior characteristics (faster switching, lower on-resistance, and lower cost.

The output of the driver circuit portion 206 is staged through two parallel banks of NMOS devices, reference numerals 218A and 218B, respectively. Appropriate capacitive coupling and transient clamping between the driver circuit portion 206 and the NMOS banks is achieved by means of capacitors 214A and 214B and Zener diodes 216A and 216B, respectively. Four NMOS devices (Q9–Q12) and four NMOS devices (Q5–Q8) are disposed in parallel banks 218A and 218B, respectively, to decrease the output impedance of the power generator, increase the drive current capability, and permit very high power dissipation in this stage. Bank 218A alternates switching with bank 218B to provide an output signal between ground and the +24 VDC supply exemplified in the configuration depicted in FIG. 2. Appropriate decoupling capacitors (e.g., C4–C7, C23–24, and C28) and transient clamping diodes 220A and 220B are also utilized in this stage. The output signal is driven to the induction coil assembly load via the connector arrangement 136 discussed in greater detail hereinabove.

Figure 3:
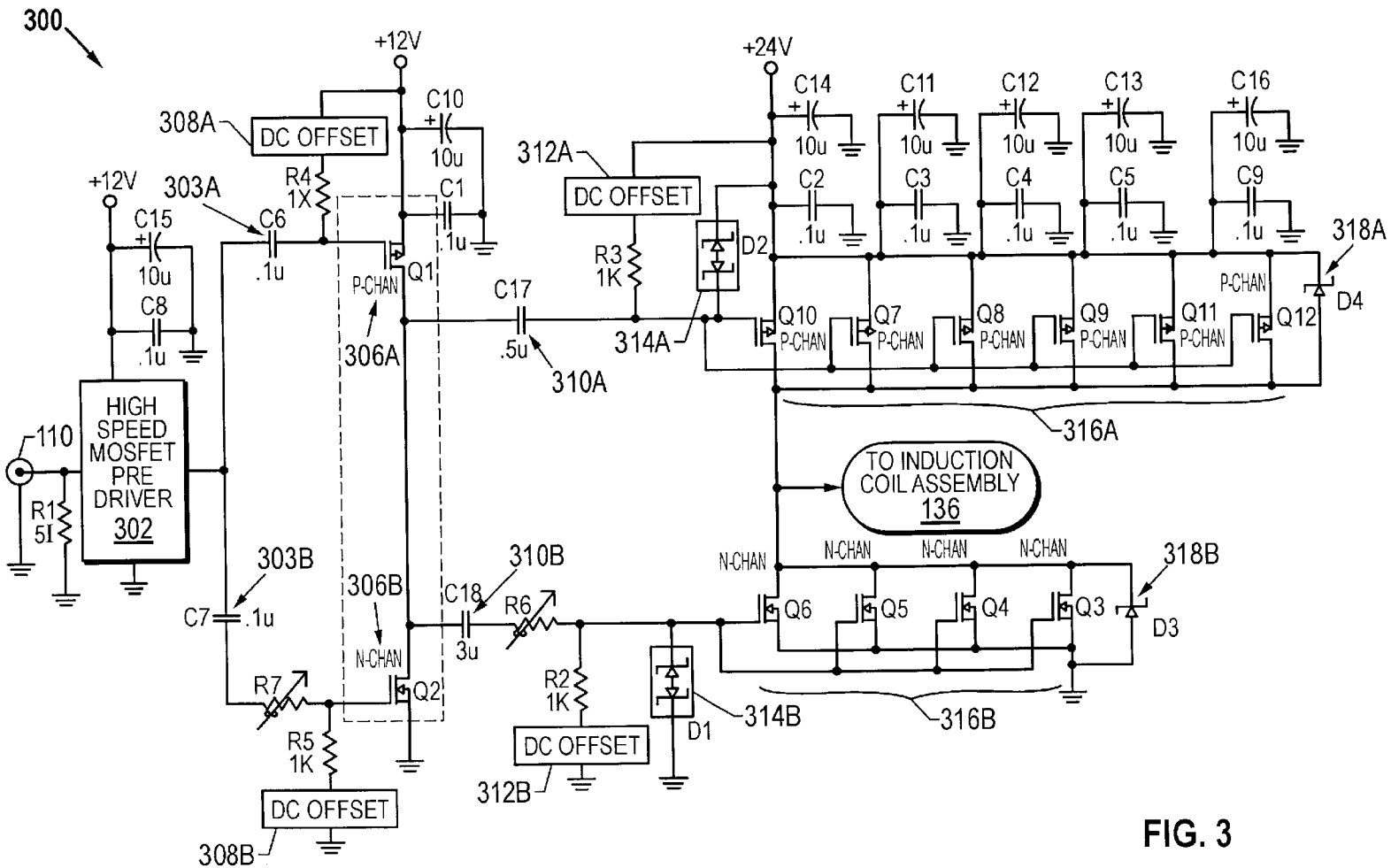
FIG. 3 depicts a circuit diagram of a second exemplary embodiment of a power output stage for use in the induction heating system of the present invention.

FIG. 3 depicts a circuit diagram of a second exemplary embodiment of a power output stage 300 for use in the induction heating apparatus of the present invention. While similar in overall operation to the power output circuit 200 described above, the power output stage 300 preferably incorporates a more compact design which uses both n-channel (NMOS) and p-channel (PMOS) devices in a complementary MOS (CMOS) arrangement as will be set forth hereinbelow.

A high-speed MOSFET pre-driver block 302 operable with a voltage supply of +12 VDC is driven by the output of VCO 110. Suitable decoupling capacitors (e.g., C15) are provided with the pre-driver block 302. A CMOS driver portion 304 is capacitively coupled to the pre-driver block 302 via capacitors 303A and 303B. Each of the gates of PMOS device 306A and NMOS device 306B forming the CMOS driver portion 304 is provided with an appropriate DC offset. Reference numerals 308A and 308B exemplify the DC offsets for PMOS and NMOS devices, respectively. As those skilled in the art should appreciate, offset to the gate drive is controllable to ensure low MOSFET turn-on impedance with minimum drive voltages.

The output of the CMOS driver portion 304 drives two banks of MOSFETs 316A and 316B that alternate output switching, wherein NMOS device 306B is turned on to drive bank 316A comprised of a plurality of output stage PMOS devices (Q7–Q12) and PMOS device 306A is operable to be turned on so as to drive bank 316B comprising a plurality of output stage NMOS devices (Q3–Q6). To compensate for the relatively poor on-resistance of the p-channel devices, the number of PMOS devices in bank 316A can be greater than the number of the NMOS devices in bank 316B of the presently preferred exemplary embodiment of the present invention.

Further, suitable capacitive coupling and transient clamping between the driver circuit portion 304 and the two output stage banks is achieved by means of capacitors 310A and 310B and Zener diodes 314A and 314B, respectively, similar to the power output stage 200 shown in FIG. 2. PMOS bank 316A alternates switching with NMOS bank 316B to provide an output signal between ground and a predetermined supply voltage, e.g., +24 VDC supply in the configuration depicted in FIG. 3. Appropriate decoupling capacitors (e.g., C2–C5, C9, C11–14, and C16) and transient clamping diodes 318A and 318B are also utilized in this stage. Again, the output signal is driven to the induction coil assembly load via the connector arrangement 136 discussed in greater detail hereinabove.

Figure 4:
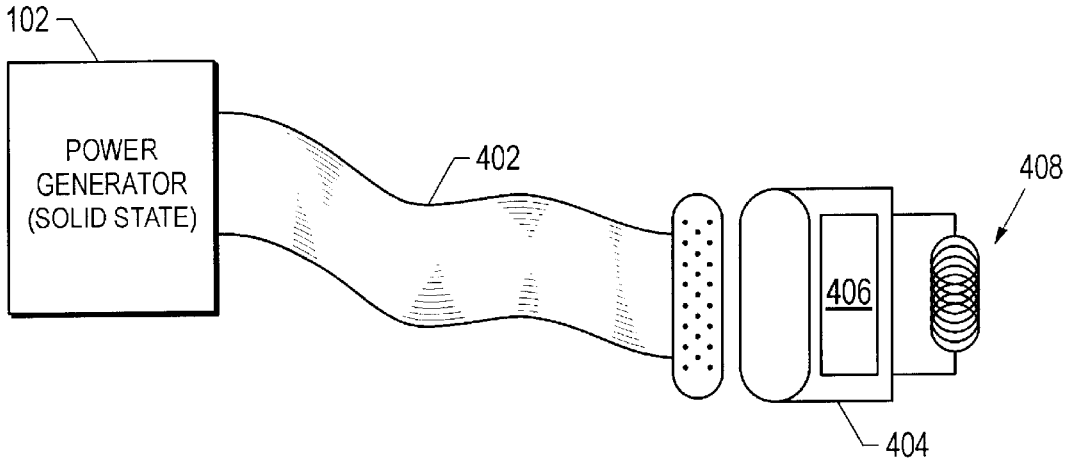
FIG. 4 depicts an exemplary twisted pair ribbon connector arrangement for coupling a low impedance inductive coil assembly load to the power generator provided in accordance with the teachings of the present invention.

Referring now to FIG. 4, depicted therein is an exemplary twisted pair ribbon connector 402 for use in association with the solid state power generator 102 of the present invention for providing induction heating. A detachable cable head 404 is provided as module external to the generator supporting capacitive circuitry 406 coupled to induction coil 408. Accordingly, it should be appreciated that a variety of coil configurations are possible for induction heating applications by selecting appropriate capacitor/coil combinations that are tunable with respect to specific target frequencies. For example, pancake coils, circular coils, square coils, cylindrical coils, helical coils, triangular and multi-angular coils, hair pin coils, rectangular coils, toroid coils, oval coils and coils of other known and hitherto unknown designs with variable number of amp-turns can be advantageously utilized for susceptor-specific induction heating. Exemplary coil design techniques discussed in the pending provisional patent application entitled Broadband High Frequency High Power Low Output Impedance Power Supply Using Switching MOSFETs, Ser. No.: 60/190,562, filed Mar. 20, 2000, in the names of Roberto A. Collins and James B. Colvin, which provisional patent application forms the basis for the present nonprovisional application's claim of priority as set forth hereinabove, are incorporated by reference herein.

Furthermore, these and other various coil designs can be additionally modified by the use of a host of core materials, e.g., ferrite cores, air cores, and the like. Some of the innovative coil designs of the present invention such as, e.g., earmuff coils, cooled core coils, coolant-supplied coils, etc. are described immediately hereinbelow.

Figure 5:
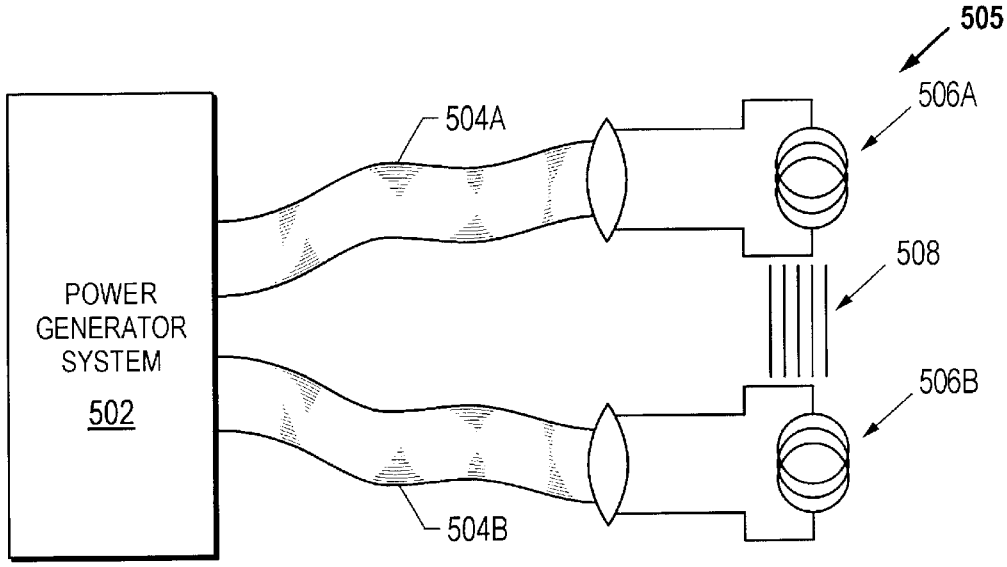
FIG. 5 depicts an exemplary induction heating arrangement for obtaining substantially uniform magnetic field around a susceptor by using an earmuff coil assembly.

FIG. 5 depicts an exemplary induction heating apparatus having an earmuff coil arrangement 505 wherein two helical coils 506A and 506B with a predetermined number of amp-turns are disposed facing each other. Coils 506A and 506B are connected to a power generator system 502 that can supply broadband high frequency power in accordance with the teachings of the present invention to one or more induction coil loads simultaneously. Thus, both coils can be coupled to the same output in phase. A separate ribbon connector 504A or 504B may preferably be used for connecting the individual loads to the power generator system 502 whereby freedom of movement can be maximized relative to a work piece. Accordingly, substantially uniform flux lines 508 may be obtained around the work piece, which can be magnetically coupled to a specific conductive portion thereof for precisely controlled inductive heating. For example, solder balls/bumps, interconnects, leads, etc. used for semiconductor packaging and/or back-end processing, either in wafer form or as singulated die, can be targeted as susceptors for reflow, re-work, failure analysis, or rapid connection formation applications.

Figure 6:
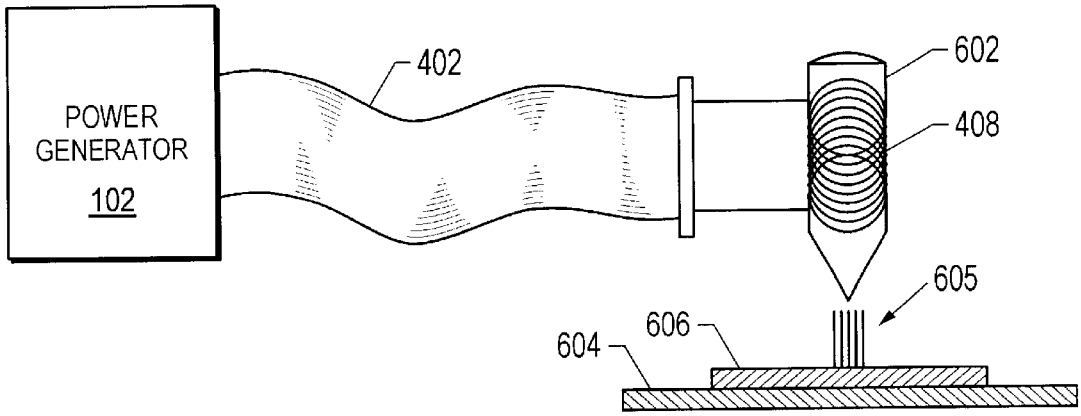
FIG. 6 depicts an exemplary induction heating arrangement for obtaining substantially focused magnetic field capable of localized heating or thermal scanning of a susceptor such as metallic interconnects of an integrated circuit in die or wafer form.

FIG. 6 depicts an exemplary induction heating system for obtaining highly focused magnetic flux lines 605 by employing a specially shaped ferrite core 602 in conjunction with coil 408. Ribbon connector 402 is provided for connecting the induction coil load to the power generator 102. By utilizing the focused flux at sufficiently high frequencies, very small conductive elements (e.g., circuit interconnects) may be coupled for thermal scanning. It should be appreciated that such a system is advantageous for localizing failures in an integrated circuit 606 disposed on a substrate 604.

Figure 7A:
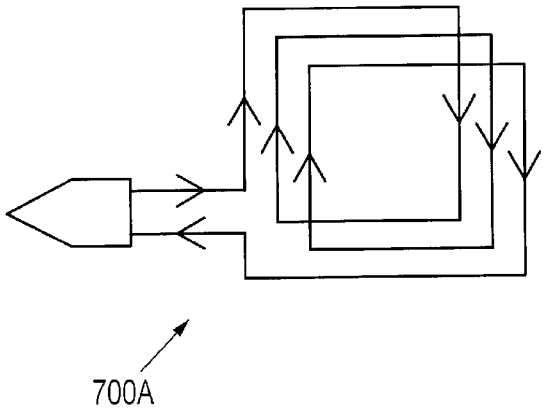
FIG. 7A (Prior Art)
FIGS. 7A and 7B depict two exemplary induction coils operable in conjunction with the apparatus of the present invention.
Figure 7B:
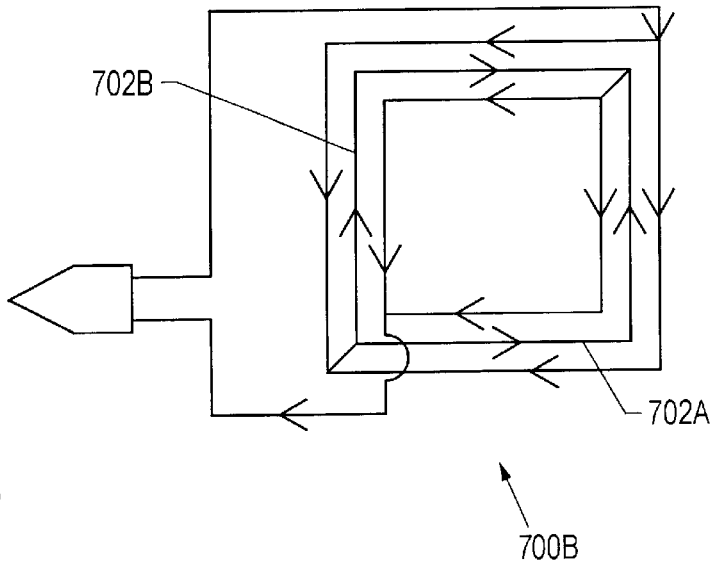

FIG. 7A depicts a conventional square coil 700A with a predetermined number of amp-turns. Because of the directionality of the current in the coil and due to limitation of the effective surface area available for magnetic coupling, the amount of flux available for induction heating is significantly reduced in the conventional square coil load. FIG. 7B depicts an improvement in the design of the square coil, wherein two opposing corners of successive square turns are coupled as shown such that the coil 700B is capable of conducting additional current due to increased effective surface area. Accordingly, magnetic flux available for inductive coupling is increased advantageously. In spite of the increased flux capability, the core of the coil 700B remains cool (i.e., a "cooled core coil"), as the flux at the center is effectively canceled. It is desirable, however, that current return paths of the coil, e.g., return paths 702A and 702B, are located on a different plane from the plane of coil itself such that the field associated with the return paths does not couple to the susceptor.

Additionally, in a further embodiment of the present invention, coils usable as inductive load assemblies may be comprised of hollow tubing rather than solid windings. Thus, appropriate coolants (water, liquid Nitrogen, and the like) can be circulated through the coil tubing (by vacuum pumps, motors, etc.) for maintaining the surface temperature of the load assembly. As a consequence, only inductive heating is selectively effectuated in the work piece, rather than non-differential bulk heating due to radiation.

Based upon the foregoing Detailed Description, it should be readily apparent that the present invention provides an innovative solution that advantageously overcomes the shortcomings and deficiencies of the conventional induction heating solutions set forth in the Background section of the present patent application. Instead of utilizing a higher ohmic load (e.g., a 50Ω load) and subsequently matching to lower impedance loads by employing a bulky step-down transformer system, the present invention's induction system utilizes a fast-switching MOSFET design to generate broadband high-frequency output that can be driven directly to a low impedance load so as to reduce footprint, and thereby provide a highly portable and compact form factor.

Additionally, the power generator circuit employed in accordance with the teachings of the present invention is tolerant of impedance changes effectuated when different susceptors are presented for heating by coupling at very high frequencies. Further, the FET design of the present invention allows broader voltage, current and frequency ranges of controllable operation.

Those skilled in the art should appreciate upon reference hereto that the teachings of the present invention may be advantageously practiced in several areas. For example, in semiconductor applications, the portable induction heating system of the present can be advantageously used as in-line equipment to effectuate precise bonding between flex circuits and the substrate strips (e.g., polyimide tapes) therefor due to the highly controlled differential heating properties of the materials involved. Because the coefficients of thermal expansion are different for the bonding and substrate materials, precise localization and efficient skin effect coupling of the present invention's induction heating system makes it possible to attach and re-flow the bonding material effectively without adversely affecting the surrounding tape material.

Also, because the inductive coupling is localized to the conductive susceptors only, the present invention can be advantageously used to further accelerate semiconductor circuit testing processes, e.g., burn-in. Additional semiconductor applications include, e.g., wafer bump re-flow, wafer rework, and packaging involving chip-scale packages, multi-chip modules, ball grid arrays, et cetera.

Moreover, the induction heating system of the present invention can be used as a commodity specialized heating source in a host of applications because of its portability, maneuverability, and versatility of coil design. The capability to tune to susceptors of different sizes and shapes is advantageous in fields as diverse as the manufacture of razor blades, fiber rods, and any components having small conductive areas that require localized thermal annealing and quenching for strength and durability. In addition, the teachings of the present patent application may be practiced in underwater and biomedical applications.

It is believed that the operation and construction of the present invention will be apparent from the foregoing Detailed Description. While the system and apparatus shown and described have been characterized as being preferred, it should be readily understood that various changes and modifications could be made therein without departing from the scope of the present invention as set forth in the following claims. For instance, whereas the specific exemplary embodiments of the present invention have been described hereinabove with particular electronic components (e.g., capacitors, resistors, diodes, MOSFETs, transformers, etc.) in terms of sizes, values, shapes, etc., it should be recognized by those skilled in the art that the use of such components is solely illustrative rather than restrictive or limiting. Thus, power generator circuit portions such as pre-driver buffers, drivers and output stages may be implemented with numerous variations. In addition, the various cascaded stages (e.g., pre-divers and drivers, output stages, etc.) of the power generator circuitry may be combined such that one or more stages can be eliminated from the design. With reference to the embodiment depicted in FIG. 3, a delay circuit may be employed in series to R7 between capacitor 303B and NMOS driver 306B so as to be able to better match the switching times of NMOS and PMOS drivers 306A and 306B, respectively. Also, a variety of operating parameters may be utilized in providing additional feedback control in the power generator system of the present invention. Accordingly, all such variations, modifications, additions, deletions, combinations, permutations, changes, amendments, adjustments, adaptations, revisions, alternations, et cetera, should be deemed to be within the ambit of the present invention whose scope is defined solely by the claims set forth immediately hereinbelow.

What is claimed is:

1. An induction heating apparatus, comprising:

a solid state power generator capable of driving a variable impedance, said generator operating with a switching regulator for generating current at a high frequency;

an induction coil assembly connected to said solid state power generator, said induction coil assembly including a capacitive circuit portion coupled to a conductive coil, wherein said conductive coil operates responsive to said high frequency current to generate a magnetic field for inductively coupling with a susceptor, thereby substantially rapidly heating said susceptor's material;

said solid state power generator including a power output stage driven under feedback control so as to effectuate resonance in said induction coil assembly at around said high frequency; and said power output stage including a pre-driver circuit portion coupled to a driver circuit portion, wherein said pre-driver circuit portion comprises a plurality of buffer circuits disposed in parallel, each buffer circuit operating to drive a transformer coupled to a field effect transistor (FET) device, and said transformer and said FET device forming at least a part of said driver circuit portion.

2. The induction heating apparatus as set forth in claim 1, wherein said switching regulator is comprised of a direct current (DC) voltage supply operable from about 10 VDC to several hundreds volts.

3. The induction heating apparatus as set worth in claim, 1, wherein said driver portion operates to drive said induction coil assembly through a plurality of n-channel metal oxide semiconductor (NMOS) FET devices coupled thereto.

4. The induction heating apparatus as set forth in claim 1, wherein said driver circuit portion comprises at least an NMOS device coupled to a p-channel MOS (PMOS) device in a complementary MOS (CMOS) circuit arrangement, and further wherein gates of said NMOS and said PMOS are provided with a DC offset.

5. The induction heating apparatus as set forth in claim 1, wherein said driver portion operates to drive said induction coil assembly through a plurality of FET devices that are comprised of a bank of NMOS devices and a bank of PMOS devices.

6. The induction heating apparatus as set forth in claim 1, further comprising a current sensor, a temperature sensor, and a phase comparator for effectuating feedback control of a voltage-controlled oscillator (VCO) via a microcontroller, said VCO forming a part of said solid state power generator.

7. The induction heating apparatus as set forth in claim 6, wherein said microcontroller is provided with a user interface selected from the group consisting of a keyboard, a display, and a pointing device.

8. The induction heating apparatus as set forth in claim 1, wherein said conductive coil is selected from the group consisting of a pancake coil, a circular coil, a square coil, a helical coil, a hair pin coil, a rectangular coil, an ear muff coil, a ferrite core coil, a cooled core coil, a toroid coil, and an oval coil.

9. The induction heating apparatus as set forth in claim 8 wherein said conductive coil is comprised of at least one turn of a copper wire.

10. The induction heating apparatus as set forth in claim 8, wherein said conductive coil is comprised of at least one turn of a hollow copper tube.

11. The induction heating apparatus as set forth in claim 10, wherein said conductive coil is cooled by circulating a coolant through said hollow copper tube.

12. The induction heating apparatus as set forth in claim 1, wherein said induction coil assembly is connected to said solid state power generator through a twisted pair ribbon connector having a plurality or conductive wires.

13. The induction heating apparatus as set forth in claim 1, wherein said induction coil assembly is connected to said solid state power generator through a coaxial cable connector.

14. A system for heating a component by inductively coupling to said component, comprising:

power generator means for generating current with a frequency at least at around 0.5 MHz;

an induction coil assembly coupled to said power generator means via connection means, wherein said induction coil assembly is resonantly operable at said frequency to couple to said component for Generating heat thereat;

said power generator means including a power output stage driven under feedback control so as to effectuate resonance in said induction coil assembly at around said frequency;

said power output stage including a pre-driver circuit portion coupled to a driver circuit portion wherein said pre-driver circuit portion comprises a plurality of buffer circuits disposed in parallel, each buffer circuit operating to drive a transformer coupled to a field effect transistor (FET) device, and said transformer and said FEN device forming at least a part of said driver circuit portion; and feedback control means for controlling said current's frequency so as to maintain resonance of said induction coil assembly during operation therefor.

15. The system for heating a component by inductively coupling to said component as set forth in claim 14, wherein said power generator means is operable with a direct current (DC) voltage supply from about 10 VDC to several hundred volts.

16. The system for heating a component by inductively coupling to said component as set forth in claim 15, wherein said power generator means includes at least one of a voltage-controlled oscillator (VCO) and a microprocessor-controlled signal generator for driving said power output stage coupled to said induction coil assembly via said connection means.

17. The system for heating a component by inductively coupling to said component as set forth in claim 14, wherein said induction coil assembly includes at least one of a capacitor portion and a resistor portion coupled to a conductive coil.

18. The system for heating a component by inductively coupling to said component as set forth in claim 17, wherein said conductive coil is selected from the group consisting of a pancake coil, a circular coil, a square coil, a helical coil, a hair pin coil, a rectangular coil, an ear muff coil, a ferrite core coil, a cooled core coil, and an oval coil.

19. The system for heating a component by inductively coupling to said component as set forth in claim 17, wherein said conductive coil is comprised of a hollow copper tube, and further wherein said component comprises a specific conductive portion of a semiconductor device.

20. The system for heating a component by inductively coupling to said component as set forth in claim 14, wherein said connection means comprises a twisted pair ribbon connector manipulable by a robotic arm.

21. A system for heating a component by inductively coupling to said component, comprising:

a solid state power generator operable without a matching transformer for generating current with a selectable frequency, said solid state cower generator including a power output stage driven under feedback control, said power output stage including a pre-driver circuit portion coupled to a driver circuit portion, wherein said pre-driver circuit portion comprises a plurality of buffer circuits disposed in parallel, each buffer circuit operating to drive a transformer coupled to a field effect transistor (FET) device, and said transformer and said FET device forming at least a part of said driver circuit portion;

an induction coil assembly coupled to said solid state power generator via connection means, wherein said induction coil assembly is resonantly operable at said selectable frequency to couple to said component for generating heat thereat; and feedback control means for controlling said current's frequency so as to maintain resonance of said induction coil assembly during operation thereof.

22. The system for heating a component by inductively coupling to said component as set forth in claim 21, wherein said solid state power generator is operable with a direct current (DC) voltage supply from about 10 VDC to several hundred volts.

23. The system for heating a component by inductively coupling to said component as set forth in claim 22, wherein said solid state power generator includes at least one of a voltage-controlled oscillator (VCO) and a microprocessor-controlled signal generator for driving said power output stage coupled to said induction coil assembly via said connection means.

24. The system for heating a component by inductively coupling to said component as set forth in claim 21, wherein said induction coil assembly includes at least one of a capacitor portion and a resistor portion coupled to a conductive coil.

25. The system for heating a component by inductively coupling to said component as set forth in claim 24, wherein said conductive coil is selected from the group consisting of a pancake coil, a circular coil, a square coil, a helical coil, a hair pin coil, a rectangular coil, an ear muff coil, a ferrite core coil, a cooled core coil, and an oval coil.

26. The system for heating a component,by inductively coupling to said component as set forth in claim 24, wherein said conductive coil is comprised of a hollow copper tube, and further wherein said component comprises a specific conductive portion of a semiconductor device.

27. The system for heating a component by inductively coupling to said component as set forth in claim 24, wherein said connection means comprises a twisted pair ribbon connector.

28. The system for heating a component by inductively coupling to said component as set forth in claim 21, wherein said selectable frequency is at least around 500 KHz.

* * * * *